US010676302B1

(12) United States Patent
Li et al.

(10) Patent No.: US 10,676,302 B1
(45) Date of Patent: Jun. 9, 2020

(54) STUB PLUCKING DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Xi-Hang Li, Zhengzhou (CN); Eddy Liu, New Taipei (TW); Jun Chen, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/564,156

(22) Filed: Sep. 9, 2019

(30) Foreign Application Priority Data

Jan. 25, 2019 (CN) ..... 2019 2 0137876 U

(51) Int. Cl.
*B25J 15/00* (2006.01)
*B65H 19/12* (2006.01)

(52) U.S. Cl.
CPC ..... *B65H 19/12* (2013.01)

(58) Field of Classification Search
CPC . B25J 13/082; B25J 15/08; B25J 15/10; B25J 9/0015; B25J 15/00061
USPC ..... 294/197, 198, 106, 110.1, 86.4, 86.54
See application file for complete search history.

(56) References Cited

U.S. PATENT DOCUMENTS 2,370,528 A * 2/1945 Fontaine ..... B66C 1/447 294/197
2,906,555 A * 9/1959 Heppenstall, Jr. ..... B66C 1/485 294/197
3,606,442 A * 9/1971 Jean-Martelee ..... B66C 1/485 294/197
4,239,165 A * 12/1980 Weiss ..... B65H 16/021 242/559.4
4,256,429 A * 3/1981 Dwyer ..... B65H 15/02 294/103.1
4,266,910 A * 5/1981 Pickard ..... B66C 1/427 294/197
4,281,961 A * 8/1981 Redman ..... B21F 33/04 198/379
4,565,400 A * 1/1986 Nakashima ..... B25J 15/0052 294/103.1
4,684,307 A * 8/1987 Lattion ..... B65H 67/061 414/788.3
6,494,400 B1 * 12/2002 Zitella ..... B65B 11/02 242/559.3

(Continued)

*Primary Examiner* — Paul T Chin
(74) *Attorney, Agent, or Firm* — ScienBiziP, P.C.

(57) ABSTRACT

A stub plucking device includes a transfer mechanism, a grasping mechanism, and a sensing mechanism. The grasping mechanism is driven by the transfer mechanism to move toward or away from a reel. The grasping mechanism includes a connector mounting a movable clasp, a fixed clasp, and a grasping driving member. The grasping driving member drives the movable clasp to move toward the fixed clasp to grasp an end stub of the reel. The sensing mechanism senses whether a contact force between the fixed clasp and the reel has reached a predetermined force. When the sensing mechanism senses that the contact force between the fixed clasp and the reel has reached the predetermined force, the transfer mechanism drives the grasping mechanism to move a predetermined distance away from the reel.

17 Claims, 4 Drawing Sheets

(56) References Cited

U.S. PATENT DOCUMENTS

| | | | | |
|---|---|---|---|---|
| 7,967,354 | B2 * | 6/2011 | Faulkner | B25J 9/0093 294/103.1 |
| 2008/0229707 | A1 * | 9/2008 | Zitella | B65B 11/025 53/64 |
| 2015/0108780 | A1 * | 4/2015 | Gatley | B25J 15/0028 294/198 |

* cited by examiner

STUB PLUCKING DEVICE

FIELD

The subject matter herein generally relates to automation systems, and more particularly to a stub plucking device for automatically grasping an end stub of a reel of material.

BACKGROUND

Generally, reels of sheet material in manufacturing operations need to be unwound by finding an end stub of the sheet material to remove the sheet material from the reel. Handling and loading of the reel are generally carried out manually, which is not efficient and prone to errors.

BRIEF DESCRIPTION OF THE DRAWINGS

Implementations of the present disclosure will now be described, by way of embodiments, with reference to the attached figures.

DETAILED DESCRIPTION

Figure 1:
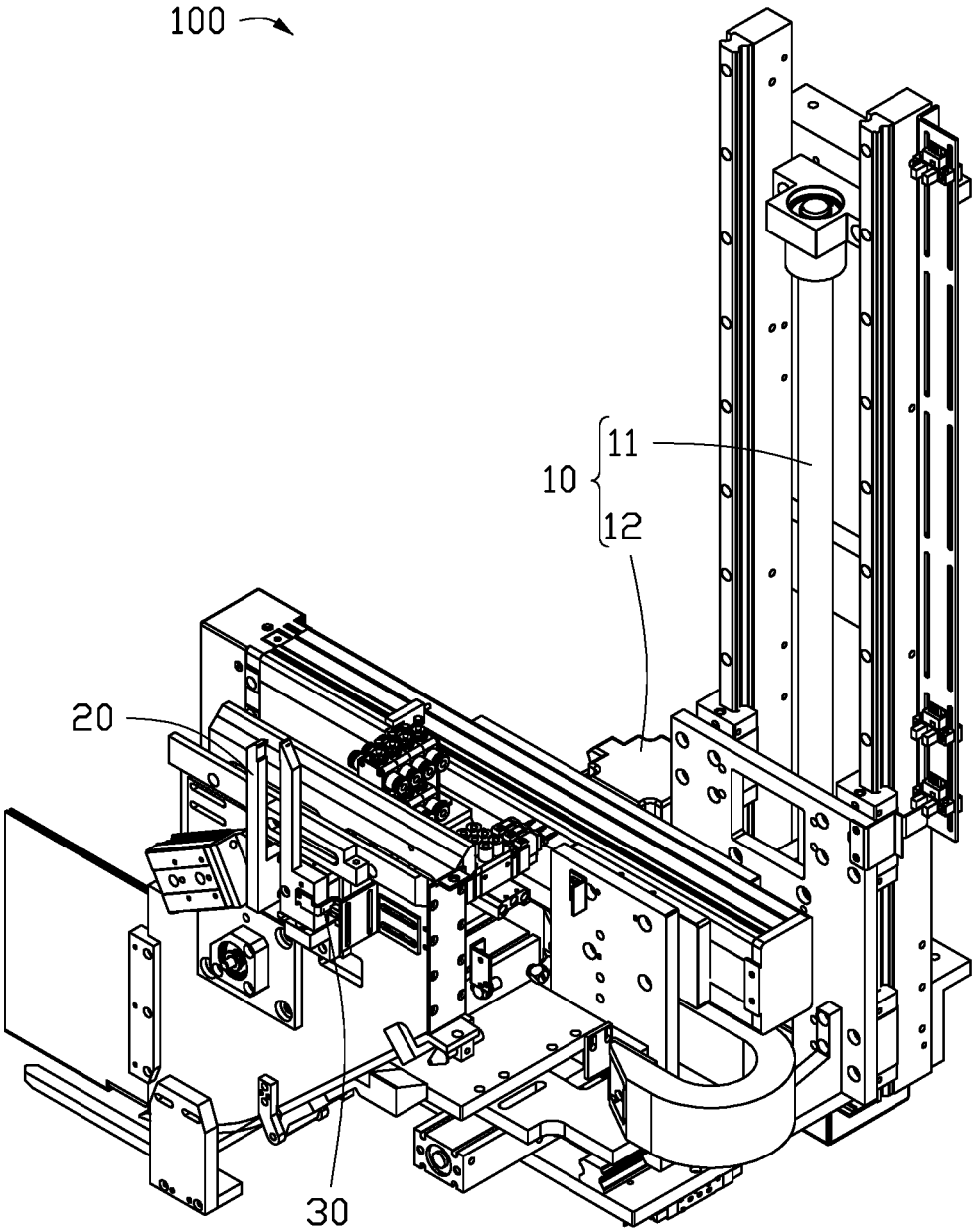
FIG. 1 is an assembled, isometric view of an embodiment of a stub plucking device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of a stub plucking device 100 for automatically plucking an end stub of a reel of material (not shown). The reel of material may be a reel of tape, a reel of fiber, or other material wound on a reel and having an end stub configured to be plucked to unwind the material from the reel. The stub plucking device 100 includes a transfer mechanism 10, a grasping mechanism 20, a sensing mechanism 30, and a control mechanism (not shown). The transfer mechanism 10 is coupled to the grasping mechanism 20 to drive the grasping mechanism 20 to move along the transfer mechanism 10 to move toward or away from the tray. The sensing mechanism 30 is mounted on the grasping mechanism 20 for sensing whether a contact force between the grasping mechanism 20 and the tray reaches a predetermined force. The control mechanism is electrically coupled to the transfer mechanism 10, the grasping mechanism 20, and the sensing mechanism 30. In one embodiment, the tray can be driven by a motor (not shown) to drive the reel to rotate so that the end stub is in a position that can be grasped by the grasping mechanism 20.

The transfer mechanism 10 includes a guiding member 11 and a driving member 12. The guiding member 11 is located on one side of the grasping mechanism 20 and is coupled to the grasping mechanism 20. The driving member 12 is configured to drive the grasping mechanism 20 to move along the guiding member 11 toward or away from the tray.

Figure 2:
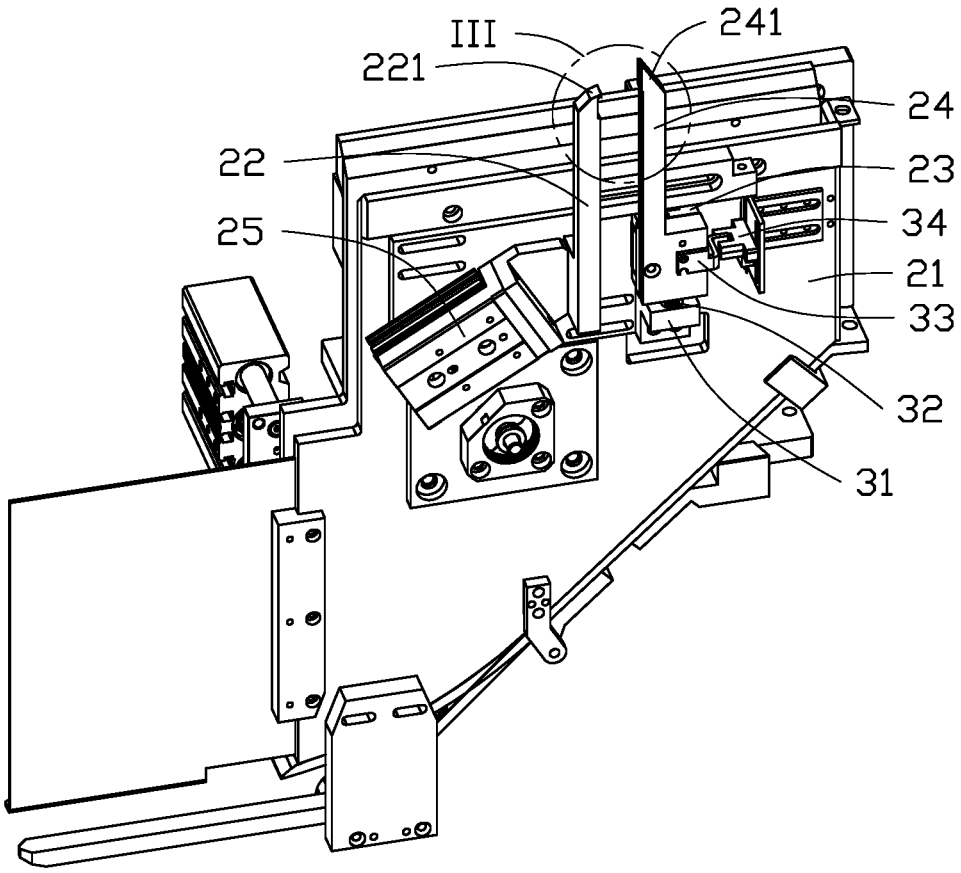
FIG. 2 is a partial view of the stub plucking device of FIG. 1.
Figure 3:
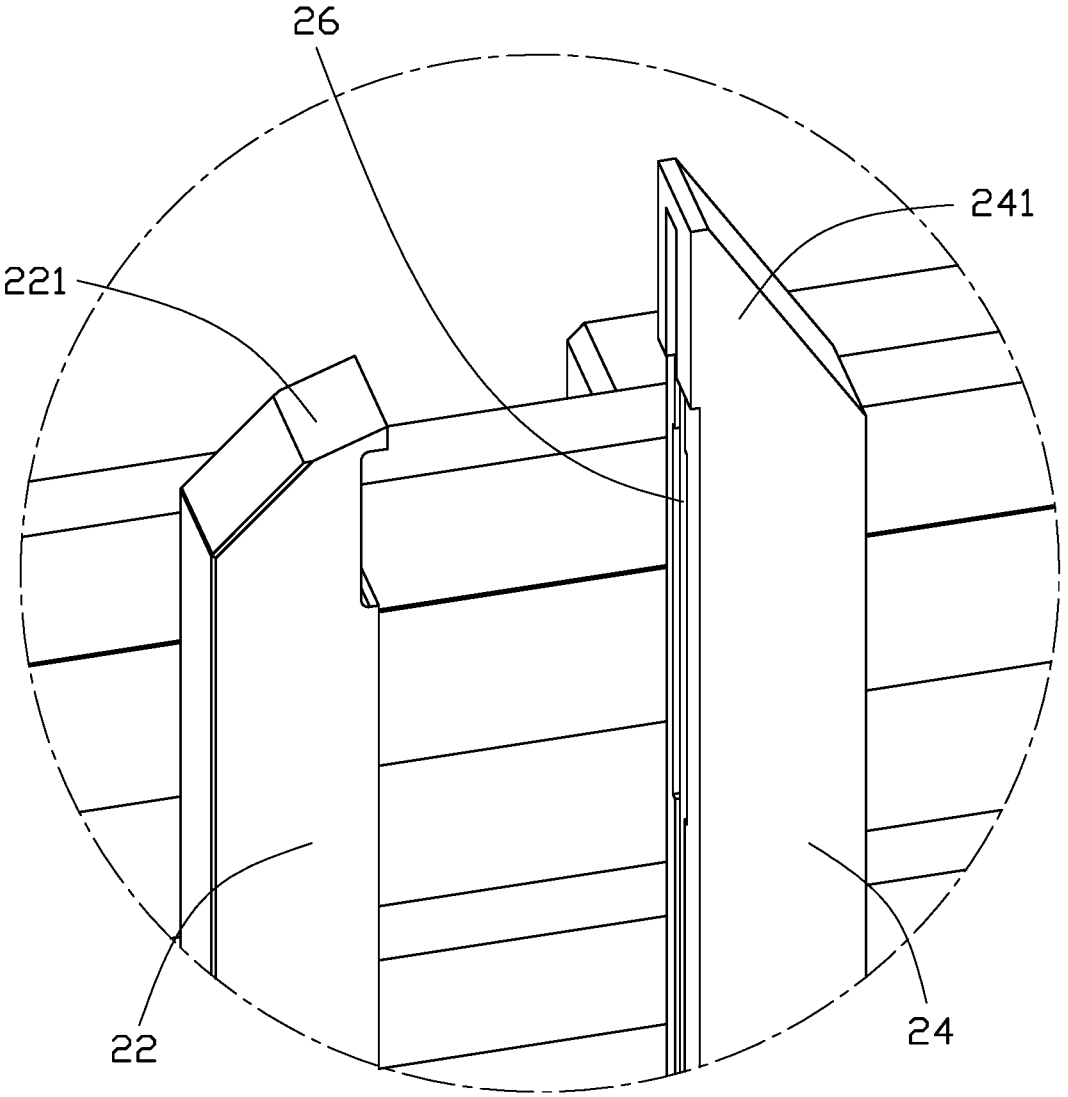
FIG. 3 is a close-up view of circled portion III of FIG. 2.

Referring to FIGS. 2 and 3, the grasping mechanism 20 includes a connector 21, a movable clasp 22, a sliding rail 23, a fixed clasp 24, a grasping driving member 25, and a sensing member 26.

The connector 21 is substantially planar and is mounted to the guiding member 11. The movable clasp 22 is arranged on a side of the connector 21 away from the guiding member 11 and is substantially elongated cuboid in shape. The sliding rail 23 is mounted to the connector 21. The sliding rail 23 is coupled to the fixed clasp 24 and is arranged adjacent to the movable clasp 22. The fixed clasp 24 is mounted on a side of the sliding rail 23 away from the connector 21 and spaced apart from the movable clasp 22. The fixed clasp 24 is substantially elongated cuboid in shape and is slidable along the sliding rail 23. An extending direction of the movable clasp 22 and the fixed clasp 24 is along the direction in which the fixed clasp 24 slides along the sliding rail 23. A movable grasping end 221 of the movable clasp 22 protrudes beyond the connector 21, and a fixed grasping end 241 of the fixed clasp 24 protrudes beyond the connector 21. A length of the movable grasping end 221 protruded beyond the connector 21 is less than a length of the fixed grasping end 241 protruded beyond the connector 21, so that the movable grasping end 221 does not obstruct the end stub of a reel of material when the reel is rotated to position the end stub to be grasped.

The grasping driving member 25 is mounted on the connector 21 and coupled to the movable clasp 22 and is configured to drive the movable clasp 22 to move toward the fixed clasp 24, so that the movable grasping end 221 is flush with the fixed grasping end 241 to grasp the end stub. In one embodiment, the grasping driving member 25 is an air cylinder, but is not limited thereto.

The sensing member 26 is mounted on a side of the fixed clasp 24 facing the movable clasp 22 and is configured to sense in real time whether the end stub is between the movable clasp 22 and the fixed clasp 24. In one embodiment, the sensing member 26 is a fiber optic sensor, but is not limited thereto.

The sensing mechanism 30 includes a mounting base 31, a resilient member 32, a sensing plate 33, and a photoelectric switch 34. The mounting base 31 is mounted on the connector 21 and arranged on a side of the fixed clasp 24 away from the fixed grasping end 241. The resilient member 32 is arranged between the mounting base 31 and the fixed clasp 24 and can resists against the mounting base 31 and the fixed clasp 24. The sensing plate 33 is fixed to the fixed clasp 24. The photoelectric switch 34 is mounted on the connector 21 and is configured to sense the sensing plate 33 after a predetermined displacement of the sensing plate 33 when the sensing plate 33 follows the fixed clasp 24 along the sliding rail 23 toward the mounting base 31, thereby sensing whether a contact force between the fixed clasp 24 and the reel reaches a predetermined force. A relationship between the contact force, the predetermined displacement, and an elastic force of the resilient member 32 is: contact force=elastic force=predetermined displacementx stiffness coefficient of the resilient member 32.

The control mechanism controls the driving member 12 to drive the grasping mechanism 20 to move along the guiding member 11 and control the grasping driving member 25 to drive the movable clasp 22 to move toward the fixed clasp 24, so that the movable grasping end 221 is flush with the fixed grasping end 241 to grasp the end stub.

The stub plucking device 100 further includes an alarm mechanism (not shown). The alarm mechanism is electrically coupled to the control mechanism, and the control mechanism controls the alarm mechanism to issue a prompt message.

In operation, the control mechanism controls the driving member 12 to drive the grasping mechanism 20 to move along the guiding member 11 toward the reel to contact the fixed clasp 24 with the reel. As the grasping mechanism 20 continues to move toward the reel, the reel resists against the fixed clasp 24 to move the fixed clasp 24 toward the mounting base 31. The resilient member 32 resists against the mounting base 31 and the fixed clasp 24, and the sensing plate 33 follows along with the fixed clasp 24 until the sensing plate 33 is sensed by the photoelectric switch 34. Then, the control mechanism controls the driving member 12 to drive the grasping mechanism 20 to move a predetermined distance along the guiding member 11 away from the reel. The reel is driven to rotate until the end stub is in a position sensed by the sensing member 26. The control mechanism controls the grasping driving member 25 to drive the movable clasp 22 to move toward the fixed clasp 24, so that the movable grasping end 221 and the fixed grasping end 241 are flush and grasp the end stub. Then, the driving member 12 is controlled to move the grasping mechanism 20 to move along the guiding member 11 away from the reel to pull out the material from the reel.

During the course of the above-described operation, if the sensing member 26 senses that the end stub is separated from the movable grasping end 221 and the fixed grasping end 241, the control mechanism controls the grasping mechanism 20 to return to an initial position and restart the above-described operation. If the end stub is separated from the movable grasping end 221 and the fixed grasping end 241 a predetermined number of times, such as three times, the control mechanism controls the alarm mechanism to issue the prompt message to prompt an operator.

Figure 4:
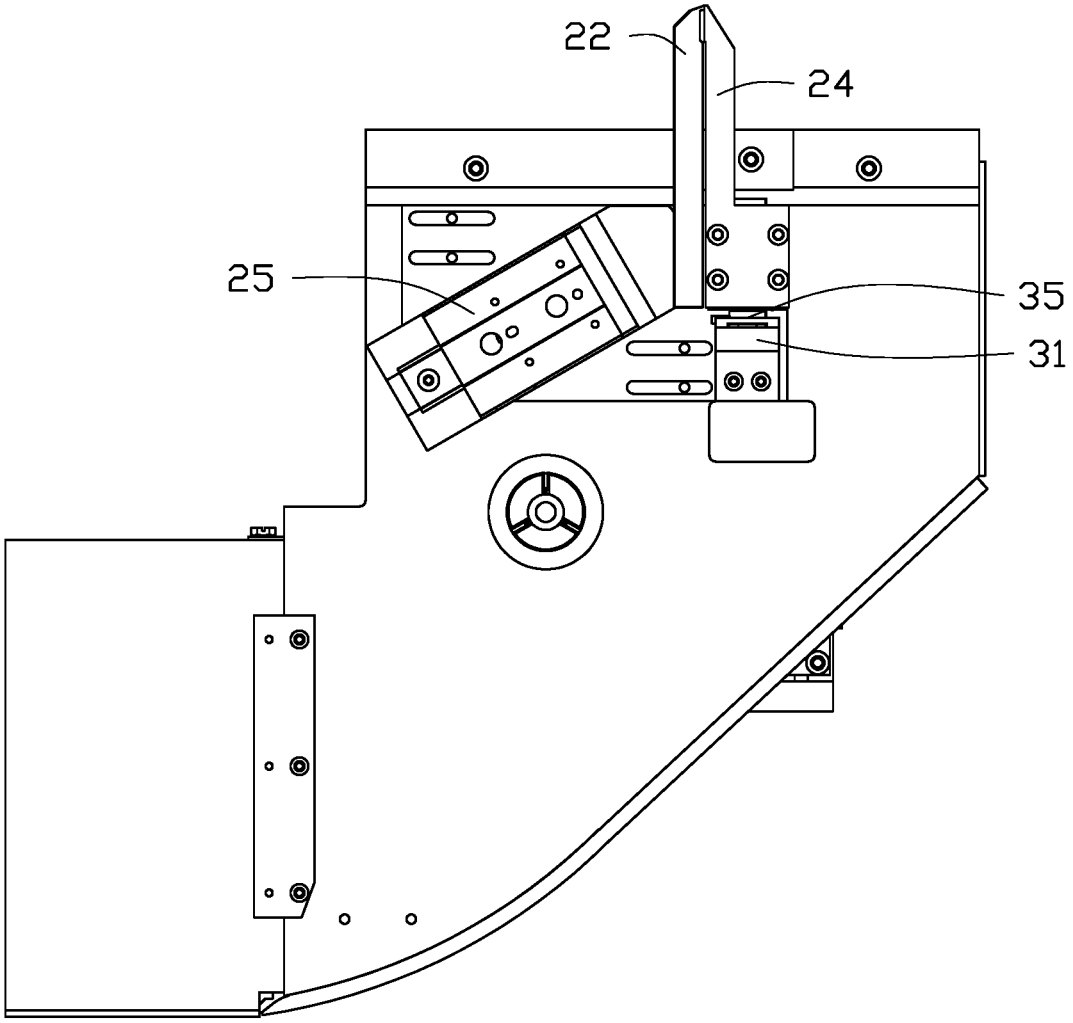
FIG. 4 is a partial view of another embodiment of the stub plucking device.

As shown in FIG. 4, in another embodiment, the resilient member 32, the sensing plate 33, and the photoelectric switch 34 may be omitted, and a pressure sensor 35 is mounted between the fixed clasp 24 and the mounting base 31 to directly detect the contact force between the fixed clasp 24 and the reel. In other embodiments, the photoelectric switch 34 can be replaced with other types of proximity switches.

Compared with the related art, the grasping driving member 25 drives the movable clasp 22 to move toward the fixed clasp 24, and the sensing mechanism 30 senses whether the contact force between the fixed clasp 24 and the reel reaches the predetermined force. When the predetermined force is reached, the control mechanism controls the transfer mechanism 10 to drive the grasping mechanism 20 to move a predetermined distance away from the reel, thereby realizing automation of grasping the end stub of reels of different sizes, and efficiency of operation is improved.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A stub plucking device for automatically grasping an end stub of a reel of material, the stub plucking device comprising:

a transfer mechanism;

a grasping mechanism; and a sensing mechanism; wherein:

the transfer mechanism, the grasping mechanism, and the sensing mechanism are electrically coupled to a controller;

the grasping mechanism is coupled to the transfer mechanism and is configured to be driven by the transfer mechanism to move toward or away from the reel;

the grasping mechanism comprises a connector, a movable clasp, a fixed clasp, and a grasping driving member;

the connector is coupled to the transfer mechanism;

the movable clasp and the fixed clasp are mounted on a side of the connector away from the transfer mechanism and spaced apart from each other;

the grasping driving member is mounted on the connector and is coupled to the movable clasp;

the grasping driving member is configured to drive the movable clasp to move toward the fixed clasp to grasp the end stub;

the sensing mechanism is mounted on the connector and is configured to sense whether a contact force between the fixed clasp and the reel has reached a predetermined force;

when the sensing mechanism senses that the contact force between the fixed clasp and the reel has reached the predetermined force, the transfer mechanism is controlled by the controller to drive the grasping mechanism to move a predetermined distance away from the reel.

2. The stub plucking device of claim 1, wherein:

the movable clasp comprises a movable grasping end protruding beyond the connector;

the fixed clasp comprises a fixed grasping end protruding beyond the connector;

a length of the movable grasping end protruded beyond the connector is less than a length of the fixed grasping end protruded beyond the connector.

3. The stub plucking device of claim 2, wherein:

the grasping driving member is configured to drive the movable clasp to move toward the fixed clasp to make the movable grasping end flush with the fixed grasping end.

4. The stub plucking device of claim 1, wherein:

the grasping mechanism further comprises a sensing member mounted on a side of the fixed clasp facing the movable clasp;

the sensing member is configured to sense in real time whether the end stub is between the movable clasp and the fixed clasp.

5. The stub plucking device of claim 2, wherein:

the grasping mechanism further comprises a sliding rail mounted on the connector;

the sliding rail is located adjacent to the movable clasp;

the fixed clasp is slidably mounted on the sliding rail and is configured to slide along the sliding rail.

6. The stub plucking device of claim 5, wherein:

the sensing mechanism comprises a mounting base, a resilient member, a sensing plate, and a photoelectric switch;

the mounting base is mounted on the connector on a side of the fixed clasp away from the fixed grasping end;

the resilient member is arranged between the mounting base and the fixed clasp and resists against the mounting base and the fixed clasp;

the sensing plate is fixed to the fixed clasp;

the photoelectric switch is mounted on the connector and is configured to sense the sensing plate after a predetermined displacement of the sensing plate when the sensing plate follows the fixed clasp along the sliding rail toward the mounting base.

7. The stub plucking device of claim 5, wherein:

the sensing mechanism comprises a mounting base and a pressure sensor;

the mounting base is mounted on the connector on a side of the fixed clasp away from the fixed grasping end; and the pressure sensor is mounted between the mounting base and the fixed clasp.

8. The stub plucking device of claim 4, wherein the sensing member is a fiber optic sensor.

9. The stub plucking device of claim 1, wherein the grasping driving member is an air cylinder.

10. A stub plucking device for automatically grasping an end stub of a reel of material, the stub plucking device comprising:

a transfer mechanism;

a grasping mechanism; and a sensing mechanism; wherein:

the transfer mechanism, the grasping mechanism, and the sensing mechanism are electrically coupled to a controller;

the grasping mechanism is coupled to the transfer mechanism and is configured to be driven by the transfer mechanism to move along a first direction toward or away from the reel;

the grasping mechanism comprises a connector, a movable clasp, a fixed clasp, and a grasping driving member;

the connector is coupled to the transfer mechanism;

the movable clasp and the fixed clasp are mounted on the connector and spaced apart on a side of the connector away from the transfer mechanism;

the grasping driving member is mounted on the connector and is coupled to the movable clasp;

the grasping driving member is configured to drive the movable clasp to move along a second direction toward the fixed clasp to grasp the end stub, the second direction is perpendicular to the first direction;

the sensing mechanism is mounted on the connector and is configured to sense whether a contact force between the fixed clasp and the reel has reached a predetermined force;

when the sensing mechanism senses that the contact force between the fixed clasp and the reel has reached the predetermined force, the transfer mechanism is controlled by the controller to drive the grasping mechanism to move along the first direction a predetermined distance away from the reel.

11. The stub plucking device of claim 10, wherein:

the movable clasp comprises a movable grasping end protruding beyond the connector;

the fixed clasp comprises a fixed grasping end protruding beyond the connector;

a length of the movable grasping end protruded beyond the connector is less than a length of the fixed grasping end protruded beyond the connector.

12. The stub plucking device of claim 11, wherein:

the grasping driving member is configured to drive the movable clasp to move toward the fixed clasp to make the movable grasping end flush with the fixed grasping end.

13. The stub plucking device of claim 12, wherein:

the grasping mechanism further comprises a sensing member mounted on a side of the fixed clasp facing the movable clasp;

the sensing member is configured to sense in real time whether the end stub is between the movable clasp and the fixed clasp.

14. The stub plucking device of claim 13, wherein:

the grasping mechanism further comprises a sliding rail mounted on the connector;

the sliding rail is located adjacent to the movable clasp;

the fixed clasp is slidably mounted on the sliding rail and is configured to slide along the first direction on the sliding rail.

15. The stub plucking device of claim 14, wherein:

the sensing mechanism comprises a mounting base, a resilient member, a sensing plate, and a photoelectric switch;

the mounting base is mounted on the connector on a side of the fixed clasp away from the fixed grasping end;

the resilient member is arranged between the mounting base and the fixed clasp and resists against the mounting base and the fixed clasp;

the sensing plate is fixed to the fixed clasp;

the photoelectric switch is mounted on the connector and is configured to sense the sensing plate after a predetermined displacement of the sensing plate when the sensing plate follows the fixed clasp along the sliding rail toward the mounting base.

16. The stub plucking device of claim 15, wherein:

the movable grasping end and the fixed grasping end cooperatively grasp the end stub of the reel; and when the movable grasping end is flush with the fixed grasping end and the sensing member senses the end stub between the fixed grasping end and the movable grasping end, the grasping mechanism is driven by the transfer mechanism to move toward the mounting base along the first direction.

17. The stub plucking device of claim 14, wherein:

the sensing mechanism comprises a mounting base and a pressure sensor;

the mounting base is mounted on the connector on a side of the fixed clasp away from the fixed grasping end; and the pressure sensor is mounted between the mounting base and the fixed clasp.

* * * * *